United States Patent [19]

Saini

[11] 4,160,968

[45] Jul. 10, 1979

[54] NORMALLY OPEN, THERMAL SENSITIVE ELECTRICAL SWITCHING DEVICE

[75] Inventor: Sarmukh S. Saini, Dayton, Ohio

[73] Assignee: Emerson Electric Co., Dayton, Ohio

[21] Appl. No.: 801,746

[22] Filed: May 31, 1977

[51] Int. Cl.[2] ..... H01H 37/76

[52] U.S. Cl. ..... 337/404; 337/401

[58] Field of Search ..... 335/404, 403, 401, 405, 335/406, 402; 361/129

[56] References Cited

U.S. PATENT DOCUMENTS

| | | | |
|---|---|---|---|
| 2,709,210 | 5/1955 | Newhall, Jr. | 337/401 |
| 4,009,422 | 2/1977 | Woodfill | 361/129 |

*Primary Examiner*—Harold Broome

*Attorney, Agent, or Firm*—Biebel, French & Nauman

[57] ABSTRACT

A temperature sensitive normally open electrical switching device has a pair of normally isolated, current carrying leads. A casing defines a central cavity and encloses first and second electrodes which are electrically connected to separate ones of the leads. An electrically conductive, fusible pellet is positioned in the cavity and melts at a predetermined temperature to form an electrically conductive path between the electrodes, regardless of the orientation of the device. The first electrode is concave and the second electrode extends into the concavity formed by the first electrode.

4 Claims, 4 Drawing Figures

NORMALLY OPEN, THERMAL SENSITIVE ELECTRICAL SWITCHING DEVICE

BACKGROUND OF THE INVENTION

The present invention relates to temperature sensitive electrical devices and, more particularly, to a temperature sensitive switch device which is normally open but which closes an electrical circuit when the device is raised to a predetermined temperature.

Thermally actuatable switch constructions are presently known in which an electrical circuit is broken or closed in response to the switch being heated to a predetermined temperature. In U.S. Pat. No. 3,875,546, issued Apr. 1, 1975, to Merrill, and U.S. Pat. No. 3,519,972, issued July 7, 1970, to Merrill, both assigned to the assignee of the present invention, temperature responsive electrical switches are disclosed in which a sliding electrical contact is held against a second electrical contact by a relatively stiff spring, which spring bears upon a normally solid, heat fusible pellet. When the switch is raised to the required temperature and the pellet melted, the stiff spring no longer opposes the force of a somewhat weaker spring which then moves the sliding contact away from the second contact, thus opening an electrical circuit.

A similar switch is shown in U.S. Pat. No. 3,180,958, issued Apr. 27, 1965, to Merrill, and assigned to the assignee of the present invention. One embodiment disclosed in the Merrill U.S. Pat. No. 3,180,958 patent includes a member of heat fusible material which holds a sliding contact away from a second contact until the fusion temperature is reached. While sliding contact, thermal switching devices of this type are extremely reliable in operation, there is always a possibility that the moving parts may bind. Additionally, thermal switches of this type require a significant number of small parts to be assembled and, therefore, the assembly costs are not insignificant.

Heat sensitive switching devices of the type used as a fuse in many electrical circuits include a heat fusible electrical conductor which conducts current between two electrodes. When the conductor is raised to its fusion temperature as a result of carrying an excessive current load, it melts and breaks the electrical circuit between the electrodes. Other fuse-like mechanisms are also known in which heat for melting an electrical conductor is supplied externally rather than by resistance heating of the conductor itself. A simple thermal switching device for closing an electrical circuit when heated to a predetermined temperature, regardless of the orientation of the switch, has not previously been available.

Thus a need exists for a temperature sensitive switching device which is simple in construction, reliable in operation, and is capable of closing an electrical circuit when raised to a predetermined temperature, regardless of the orientation of the device.

SUMMARY OF THE INVENTION

A temperature sensitive, normally open, electrical switching device has a pair of normally isolated, current carrying leads. A casing defines a central cavity in which are positioned first and second electrodes. The first and second electrodes are, in turn, electrically connected to separate ones of the leads. A fusible pellet is provided in the cavity for melting when the device is heated to a predetermined temperature and for forming an electrically conductive path between the first and second electrodes, regardless of the orientation of the device. The first electrode is concave and the second electrode extends into the concavity formed by the first electrode.

The casing may comprise a hollow cylindrical conductive case having a first end defining an opening into a central cylindrical cavity and a second end which is closed. The interior of the conductive case then forms the first electrode. The second electrode is a conductive member which extends more than halfway through the central cylindrical cavity in the case. Nonconductive means are provided for mounting the conductive member such that it extends into the cylindrical cavity substantially along the central axis of the cavity. The nonconductive means additionally seals the opening into the cavity. The pellet may be substantially annular in shape with a central cavity, and dimensioned to surround the conductive member without electrically contacting it.

The volume of the pellet must be sufficient to establish an electrically cnductive path between the case and the member, regardless of the orientation of the device. This volume will always be sufficient if it is at least as great as one half the volume of the central cylindrical cavity in the case and the electrically conductive member extends more than halfway through the central cylindrical cavity in the case. Typical heat fusible pellet compositions may include bismuth alloys.

Accordingly, it is an object of the present invention to provide a switch which completes an electrical circuit when heated to a predetermined temperature; to provide such a switch in which no sliding contact mechanisms are used; to provide such a switch in which switch operation is effectively accomplished, regardless of physical orientation of the switch; to provide such a switch in which the predetermined temperature for switch actuation may be varied; and to provide such a switch which is simple to assemble and economical to produce.

Other objects and advantages of the invention will be apparent from the following description, the accompanying drawings and the appended claims.

DETAILED DESCRIPTION OF THE PREFERRED EMBODIMENT

Figure 1:
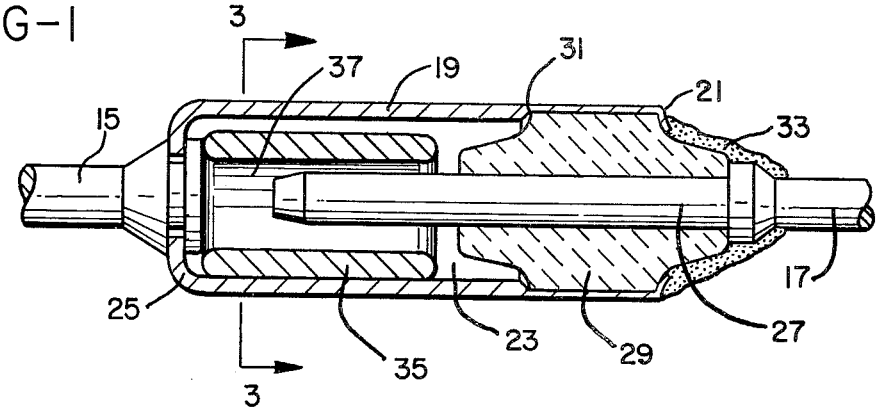
FIG. 1 is a partial sectional view taken generally axially with respect to the switch of the present invention, prior to actuation.

Reference is now made to FIG. 1 in which an axial sectional view of a temperature sensitive switching device embodying the present invention is shown. The switching device has first and second current carrying electrical leads 15 and 17 and provides a completed electrical circuit between these leads when the temperature of the switch exceeds a predetermined temperature level. A hollow cylindrical conductive case 19 has a first end 21 defining an opening into a central cylindrical cavity 23 and a second end 25 which is closed.

The case 19 forms a first concave electrode and is electrically connected to the first electrical lead 15. An electrically conductive member 27 forms a second electrode and comprises a cylindrical post which is electrically connected to the second electrical lead 17. Nonconductive means for mounting the member 27 such that it extends into the cylindrical cavity 23 substantially along the central axis of the cavity and further seals the opening into the cavity includes a ceramic bushing 29 which is held in place by a groove 31 in case 19. The outer end 21 of case 19 is crimped inwardly against a shoulder of the ceramic bushing to secure it in place. A sealing compound 33 covers the end of the bushing and seals the opening into the cavity.

Figure 2:
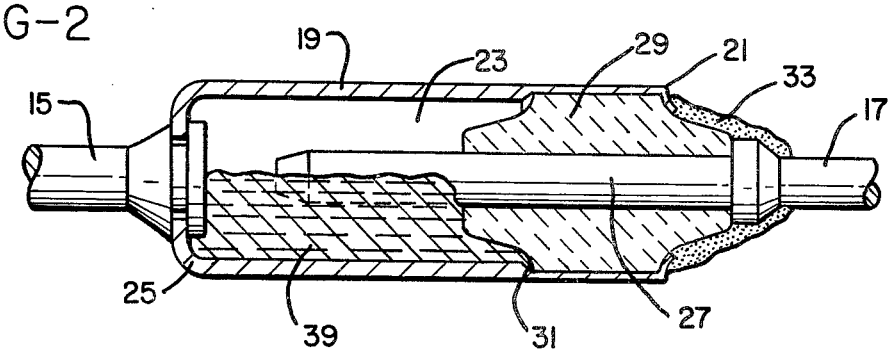
FIG. 2 is a view similar to FIG. 1 showing the switch condition after the switch is raised to a predetermined temperature.

A substantially annular, heat fusible pellet 35 defines a central pellet cavity 37 and is dimensioned to surround the member 27 without electrically contacting it. The pellet is made of a conductive material which is fusible at a predetermined temperature to form a volume of electrically conductive liquid. The volume of liquid formed by fusion of the pellet is sufficient to establish an electrically conductive path between the case 19 and the member 27, regardless of the orientation of the switching device. FIG. 2 depicts the state of the device after it is raised to its predetermined temperature and the pellet 35 melts. As is clear from the figure, an electrical circuit between leads 15 and 17 is now formed by member 27, fused material 39 and case 19. This circuit will be maintained regardless of whether the device is cooled and the conductive liquid allowed to solidify or whether the device is held at an elevated temperature. The pellet 35 may be formed of various alloys. One alloy which has been found to be useful for this purpose is 55.5% bismuth and 44.5% lead by weight, having a fusion temperature of approximately 255° F.

Figure 3:
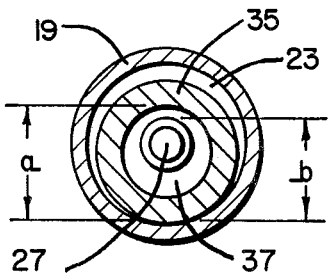
FIG. 3 is a view taken generally along line 3—3 in FIG. 1.

The manner in which the circuit is held open before fusion of the pellet 35 is illustrated more completely in FIG. 3. The pellet 35 is not held securely in position in cavity 23 but is permitted to move freely. It would be possible to use a pellet having a larger outside diameter than that shown in FIG. 3 but with the same volume and to press fit such a pellet into case 19. It will be appreciated, however, that such a construction would introduce an additional manufacturing tolerance into the device and require the production of a part having improved dimensional stability. By using the pellet design shown in the drawings, a pellet of only approximate dimensions may be easily inserted into the casing cavity without worry as to its correct positioning. As seen in FIG. 3, all that is needed for maintaining the pellet 35 out of contact with the member 27 is for the sum of the ouside radius of the pellet and the radius of the central pellet cavity to exceed the sum of the radius of the cylindrical cavity of the case and the radius of the cylindrical post. The former is illustrated as dimension a while the latter is shown as dimension b.

Figure 4:
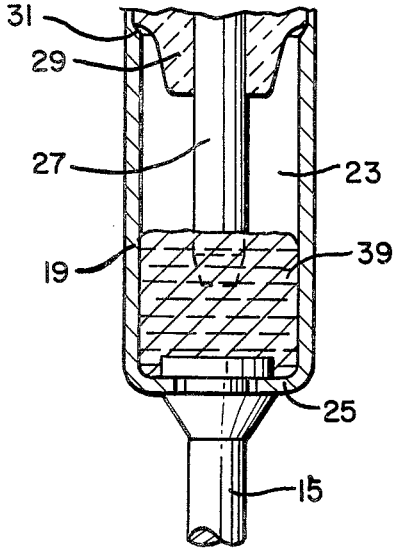
FIG. 4 is a partial view similar to FIG. 2 but showing the condition of the switch when actuated in a different orientation.

FIG. 4 illustrates the condition of the device after it is heated to the predetermined temperature while held in a different orientation. It is seen that the electrical contact desired between the leads 15 and 17 will be assured of occurring when the conductive member 27 extends more than halfway through the central cylindrical cavity and the volume of the fluid 39 is at least as great as one half the volume of the central cylindrical cavity 23. In actuality, the larger in diameter the member 27, and the closer member 27 comes to the closed end 25 of the case 19, the less volume of fusible material will be required.

While the form of apparatus herein described constitutes a preferred embodiment of the invention, it is to be understood that the invention is not limited to this precise form of apparatus, and that changes may be made therein without departing from the scope of the invention.

What is claimed is:

1. A temperature-sensitive electrical switching device, having first and second current carrying electrical leads, for completing an electrically conductive circuit between the first and second electrical leads when the temperature of the switching device exceeds a predetermined temperature level, comprising:

a hollow cylindrical electrically conductive case, having a first end defining an opening into a central cylindrical cavity and a second end which is closed, said case being electrically connected to the first electrical lead, an electrically conductive member electrically connected to the second electrical lead, nonconductive means for mounting said conductive member such that it extends into said cylindrical cavity substantially along the central axis of said cavity, said nonconductive means sealing said opening into said cavity, and a substantially annular, heat fusible pellet defining a central cavity and dimensioned to surround said member without electrically contacting said member, said pellet being fusible at said predetermined temperature to form a volume of electrically conductive liquid sufficient to establish an electrically conductive path between said case and said member regardless of the orientation of said device.

2. The device of claim 1 in which said conductive member is a conductive, cylindrical post and in which the sum of the outside radius of said pellet and the radius of said central pellet cavity exceeds the sum of the radius of said central cylindrical cavity in said case and the radius of said cylindrical post.

3. The device of claim 1 in which said heat fusible pellet is formed of a bismuth alloy.

4. The device of claim 1 in which said electrically conductive member extends more than halfway through said central cylindrical cavity in said case and further in which the volume of conductive fluid formed by the melting of said pellet is at least as great as one half the volume of said central cylindrical cavity in said case.

* * * * *